US007418776B2

(12) United States Patent
Pintos et al.

(10) Patent No.: US 7,418,776 B2
(45) Date of Patent: Sep. 2, 2008

(54) METHOD OF MANUFACTURING AN ANTENNA

(75) Inventors: Jean-François Pintos, Bourgbarre (FR); Philippe Minard, Saint Medard sur Ille (FR); Ali Louzir, Rennes (FR); Philippe Chambelin, Chateaugiron (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 11/052,958

(22) Filed: Feb. 8, 2005

(65) Prior Publication Data

US 2005/0179597 A1 Aug. 18, 2005

(30) Foreign Application Priority Data

Feb. 12, 2004 (FR) ..... 04 50256

(51) Int. Cl.
*H01P 11/00* (2006.01)

(52) U.S. Cl. ..... 29/600; 29/831; 29/606; 343/895

(58) Field of Classification Search ..... 29/600, 29/601, 602.1, 605–609, 830, 846; 343/700 MS, 343/895, 878, 873; 264/418, 46.6, 46.8
See application file for complete search history.

(56) References Cited

U.S. PATENT DOCUMENTS

| | | | | |
|---|---|---|---|---|
| 3,596,273 | A * | 7/1971 | Francis et al. | 343/793 |
| 4,725,395 | A * | 2/1988 | Gasparaitis et al. | 264/250 |
| 5,701,129 | A * | 12/1997 | Itou et al. | 343/873 |
| 5,808,585 | A * | 9/1998 | Frenzer et al. | 343/872 |
| 6,002,377 | A | 12/1999 | Huynh et al. | |
| 6,046,707 | A | 4/2000 | Gaughan et al. | |
| 6,137,452 | A * | 10/2000 | Sullivan | 343/873 |
| 6,176,010 | B1 * | 1/2001 | Droz | 29/832 |
| 6,292,156 | B1 * | 9/2001 | Openlander | 343/895 |
| 6,373,448 | B1 * | 4/2002 | Chun | 343/895 |
| 6,452,569 | B1 * | 9/2002 | Park et al. | 343/895 |
| 6,501,437 | B1 * | 12/2002 | Gyorko et al. | 343/895 |
| 6,886,237 | B2 * | 5/2005 | Leisten et al. | 29/600 |
| 7,038,636 | B2 * | 5/2006 | Larouche et al. | 343/895 |
| 7,047,624 | B2 * | 5/2006 | Vogt | 29/600 |
| 7,260,882 | B2 * | 8/2007 | Credelle et al. | 29/600 |

FOREIGN PATENT DOCUMENTS

| | | |
|---|---|---|
| EP | 1 069 647 A1 | 1/2001 |
| EP | 1 343 223 A1 | 9/2003 |
| WO | WO 98/24143 | 6/1998 |

OTHER PUBLICATIONS

Search Report.
MacLean R.: "Cold Forged Corkscrew Helixes" Internet Article, en ligne? XP002298670 Canada.

* cited by examiner

*Primary Examiner*—Minh Trinh
(74) *Attorney, Agent, or Firm*—Joseph J. Laks; Robert D. Shedd; Brian J. Cromarty

(57) ABSTRACT

The present invention relates to a method for producing an antenna comprising a conductive wire, formed by a wire, made of a conductive material, whose path has a helical shape. In accordance with the invention, such a method is characterized in that a print is formed in relief on one side of an element of an electrically insulating material such that the helical shape is generated by depositing the conductive material in this print.

7 Claims, 4 Drawing Sheets

METHOD OF MANUFACTURING AN ANTENNA

This application claims the benefit, under 35 U.S.C. § 119 of French Patent Application No. 0450256, filed Feb. 12, 2004.

The present invention relates to a method for manufacturing an antenna and/or a network of antennas, as well as an antenna and/or network of antennas manufactured according to such a method. It particularly relates to helical antennas or networks of helical antennas.

BACKGROUND OF THE INVENTION

An antenna is a unit for transmitting and/or receiving electromagnetic radiation. It is used in numerous communication systems that require one or more of these radiating units.

When several antennas are associated for a single common function, the set of these antennas is known as a network of antennas. A network of antennas provides certain advantages in relation to one antenna, such as providing greater directivity, the equivalent radiating aperture of a network being greater than that of a single antenna within this network.

Helical antennas, i.e. antennas formed by a conductive wire whose path describes a helix, are used in many systems such as mobile phones, sources for the focal points of a concentrating system or the major antenna networks.

FIG. 1*a* shows the projection of a helical antenna 100 onto a plane comprising the longitudinal axis 104 of the antenna and FIG. 1*b* shows the projection view of the antenna 100 on a plane perpendicular to the longitudinal axis 104 of the antenna.

FIG. 1*b* enables the interior 105 of the helix to be defined as the volume generated by the cylinder of an axis and radius equal to the axis and radius of the helix, the exterior 107 of the helix being the volume surrounding the interior 105.

A helical antenna 100 comprises one or more conductive wire segments 102 of a helical or spiral form. Each segment 102 can be defined by its length 108 according to the longitudinal axis 104, by the number of turns 110, by the cross-section 112 of the wire, by the pitch 114 of the helix, by the angle of inclination 116 of the helix (angle between a tangent to the helix and a plane perpendicular to the axis 104 of the antenna), by the radius 106 of the helix and by the nature of the conductive material forming the wire.

Moreover, it must be noted that these parameters can be variable or constant along the axis 104 of the helix, and particularly along a segment 102.

Such a helical antenna 100 has several operating modes that depend on various parameters such as its radius 106, its angle 116 of inclination of the turns 110 and its pitch 114.

According to a first polarisation mode, a helix can be polarised along its longitudinal axis 104 (linear polarisation) in a mode called normal, this linear polarisation being used particularly in mobile phones.

According to a second mode, a helix can also be polarised in a circular manner (circular polarisation in a mode known as axial) around the helix axis when the helix radius is in the order of the wavelength of the waves to be transmitted or received, this circular polarisation being generally used, for example, for the helical antennas present at the focal points of parabolic antennas used to receive and transmit electromagnetic waves coming from satellites.

In this latter case, the quality of the circular polarisation depends on the number of turns 110, whereas the directivity depends on the length 108 of the antenna.

It is known that a helical antenna is manufactured according to several distinct methods, these methods being described hereafter:

A first manufacturing technique consists in conferring a helical profile on a conductive wire by forming, in a manner analogous to the manufacture of a spring.

A second manufacturing technique consists in winding a conductive wire around an insulating element such as a plastic tube or a foam block, the insulating element being used to support the helix.

The insulating element can subsequently be left or removed if the strength of the helical antenna is great enough to retain its shape without the support.

A third technique consists in printing one or more conductive lines diagonally on a substrate, for example, a sheet of an insulating element that is folded onto itself, thus forming a helix whose angle of inclination is the angle of the diagonal on the substrate.

Moreover, when antennas are manufactured individually, it may be necessary to group these antennas into a network, in which case these antennas must be linked together by a rigid conductive element and a driver circuit.

These methods for manufacturing antennas have various drawbacks. Hence, the forming technique requires sufficient rigidity from the conductive element whereas the manufacturing methods according to the second and third techniques, i.e. by winding around a support or by folding a substrate, are relatively complex and costly to implement, particularly owing to the required deformation of the conductive wire (for winding) or the substrate (for folding).

Finally, these known methods only apply to the manufacture of individual antenna of such a sort that grouping several antennas into a network requires other specific operations, thus increasing the cost of manufacturing a network.

During these operations specific to grouping antennas into a network, it must be noted that each antenna must be connected to the entire network with a mechanical rigidity sufficient to retain, over a long period, the polarisation characteristics of the antenna network in its entirety, which is particularly complex and costly.

Now, it is known that, in a network, the antennas must keep their directions with respect to each other and with respect to the driver circuit, so that the driver circuit can maintain its performances.

BRIEF SUMMARY OF THE INVENTION

The present invention solves at least one of the problems cited above. It particularly results from the observation that a helix cannot be superimposed when its shape is projected onto a surface parallel to its axis, as shown in FIG. 1*a*.

This is the reason that the invention relates to a method for manufacturing an antenna comprising a wire, made of a conductive material, whose path has a helical shape characterised in that a print is formed in relief on one side of an element made of an electrically insulating material such that the helical shape is generated by depositing the conductive material in this print.

Thanks to the invention, it is possible to manufacture an antenna with a limited cost, because simply depositing the conductive wire onto a bearing surface according to the invention enables such an antenna to be generated.

In particular, it is unnecessary to shape a conductive wire, according to the winding and forming methods described above, or to fold a substrate to obtain the helical shape, which simplifies the manufacture of the antenna.

Moreover, the invention enables a large number of different helical antennas to be manufactured with a great flexibility in design, as the variation in physical parameters between the antennas to manufacture can be taken into account merely by varying the bearing surfaces of these antennas according to these parameters.

Hence, many parameters can be modified easily with a manufacturing method according to the invention. For example, the material of the insulating element, its dielectric index (which enables the radioelectric characteristics to be modified), the conducting material and the different helical profiles possible for the antennas.

The invention also relates to a method for manufacturing a network of antennas characterised in that several antennas are manufactured on a single insulating element by the helical antenna manufacturing method of the invention.

Thanks to this invention, it is possible to group helical antennas into a network in a simple, reliable, reproducible and rapid manner that is analogous to the method of manufacturing each of the antennas forming the network.

Moreover, the entire antenna network is rigid thanks to the common support, which enables it to maintain the relative direction of the antennas with respect to each other, and therefore to maintain the performances of the network.

It is also possible to associate the driver circuit in a single industrial operation, as in for example the printing of coplanar lines or the addition of a microstrip with substrate and ground plane on the same insulating element where the antennas of the network are manufactured. This method is, like the method for manufacturing the antennas, a simple method to implement and requiring limited production costs.

The invention also relates to a helical antenna or a network of helical antennas manufactured according to a manufacturing method in accordance with the invention.

In one embodiment, the contact surface between the conductive material and the insulating element in the print is located within the helix for some sections and outside the helix for other sections.

According to one embodiment, the material of the electrically insulating element is obtained by moulding or by forming.

In one embodiment, the conductive element is formed by depositing a metallic material on the insulating element.

According to one embodiment, the insulating element is foam.

In one embodiment, the print is generated by the mechanical pressure of a helical die on the side of the insulating element.

According to one embodiment, the helical die generating the print is a model of the antenna to manufacture.

In one embodiment, the print comprises a regular series of grooves along a longitudinal axis, corresponding to the axis required for the helical antenna, practically parallel to each other and uniformly spaced by a peak to peak distance equal to the pitch required for the helical antenna, the angle between the direction of the grooves and the perpendicular of the antenna axis corresponding to the angle of inclination required for helical antenna.

According to one embodiment, the conductive wire is deposited by spraying metallic particles into the print by means of a stencil.

In one embodiment, the stencil has a relief corresponding to the relief of the bearing surface.

The invention also relates to a method for manufacturing a network of antennas comprising at least two antennas with a helical shape, characterised in that at least two of these antennas are manufactured according to a method in accordance with one of the above embodiments.

In one embodiment, the antennas are manufactured using a single electrically insulating element.

According to one embodiment, the antennas are connected by a conductive circuit printed onto the electrically insulating element.

In one embodiment, a driver circuit is integral with the electrically insulating element.

According to one embodiment, the driver circuit is printed or engraved onto a substrate glued to the electrically insulating element.

The invention also relates to a helical antenna characterised in that it is manufactured by a manufacturing method compliant with one of the aforementioned antenna manufacturing method embodiments.

Finally, the invention also relates to a network of antennas characterised in that it is manufactured by a manufacturing method in accordance with one of the aforementioned antenna manufacturing method embodiments.

BRIEF DESCRIPTION OF THE DRAWINGS

Other characteristics and advantages of the invention will emerge with the description made below as an example, which is descriptive and non-restrictive, and refers to the figures herein where.

DESCRIPTION OF PREFERRED EMBODIMENTS

In the preferred embodiment of the invention described hereafter, in accordance with the invention, a print is used to deposit a conductive wire on the bearing surface such that the path of the wire according to this print is helical.

To this purpose, an electrical insulating material is chosen, selected according to the dielectric index required for the antenna, considering that the radiating body of the antenna (the conductive wire) is brought into contact with this material.

Moreover, this material has a capacity to be shaped, which is why in this embodiment, the material comprises foam, for example in polymethacrylimide or expanded polystyrene. The known usable polymethacrylimide foams have, for example, a permittivity Er varying between 1.07 and 1.08 and a loss tangent varying between 0.0002 and 0.0003.

The expanded polystyrene foams have, for example, a permittivity Er in the order of 1.56 and a loss tangent in the order of 0.002.

Subsequently, one of the two methods described above is implemented, producing a print on the foam.

Figure 1A:
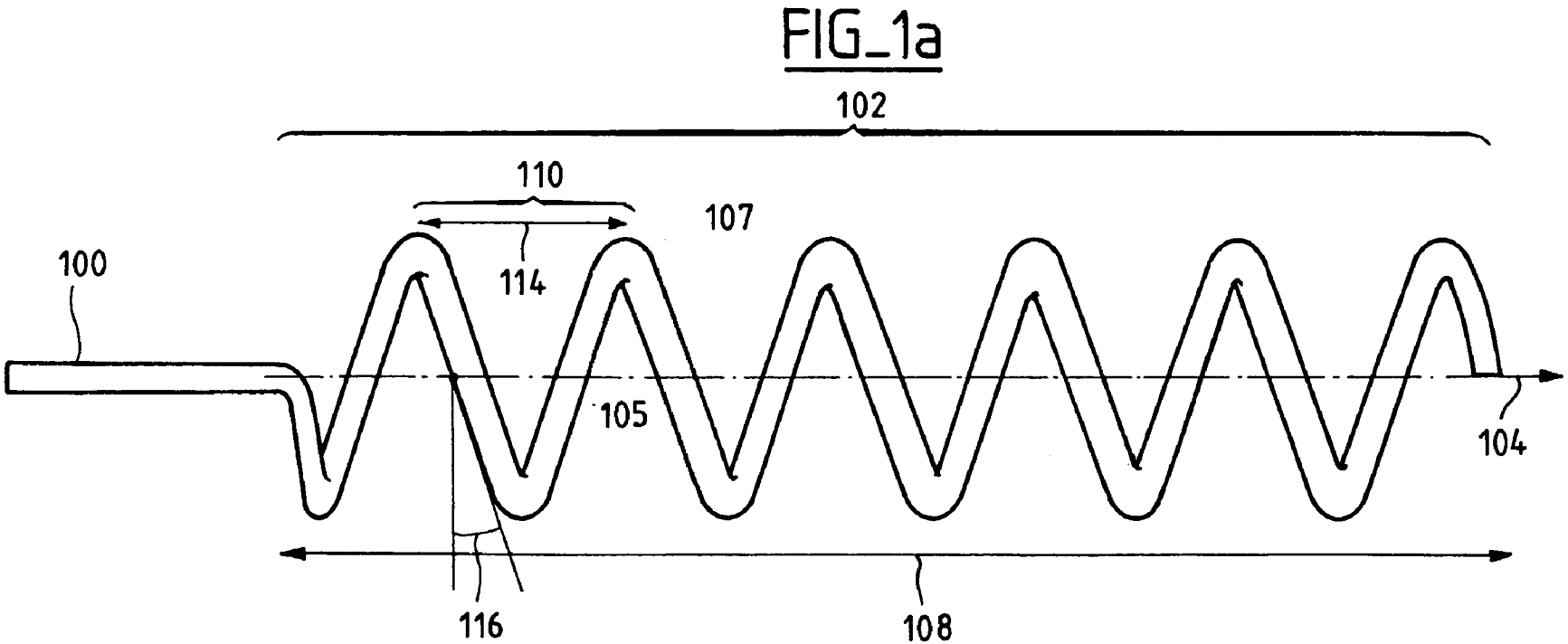
FIGS. 1*a* and 1*b*, described above, show two diagrammatic views of a simple helical antenna, FIGS. 2*a* and 2*b* diagrammatically show two stages of the method for manufacturing an antenna according to a first preferred embodiment of the invention.
Figure 1B:
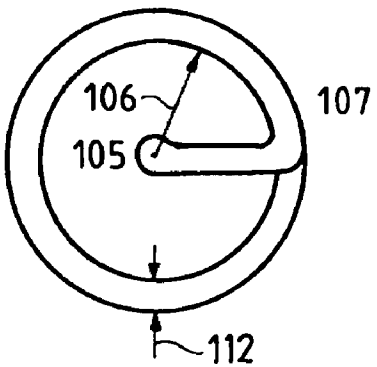
Figure 2A:
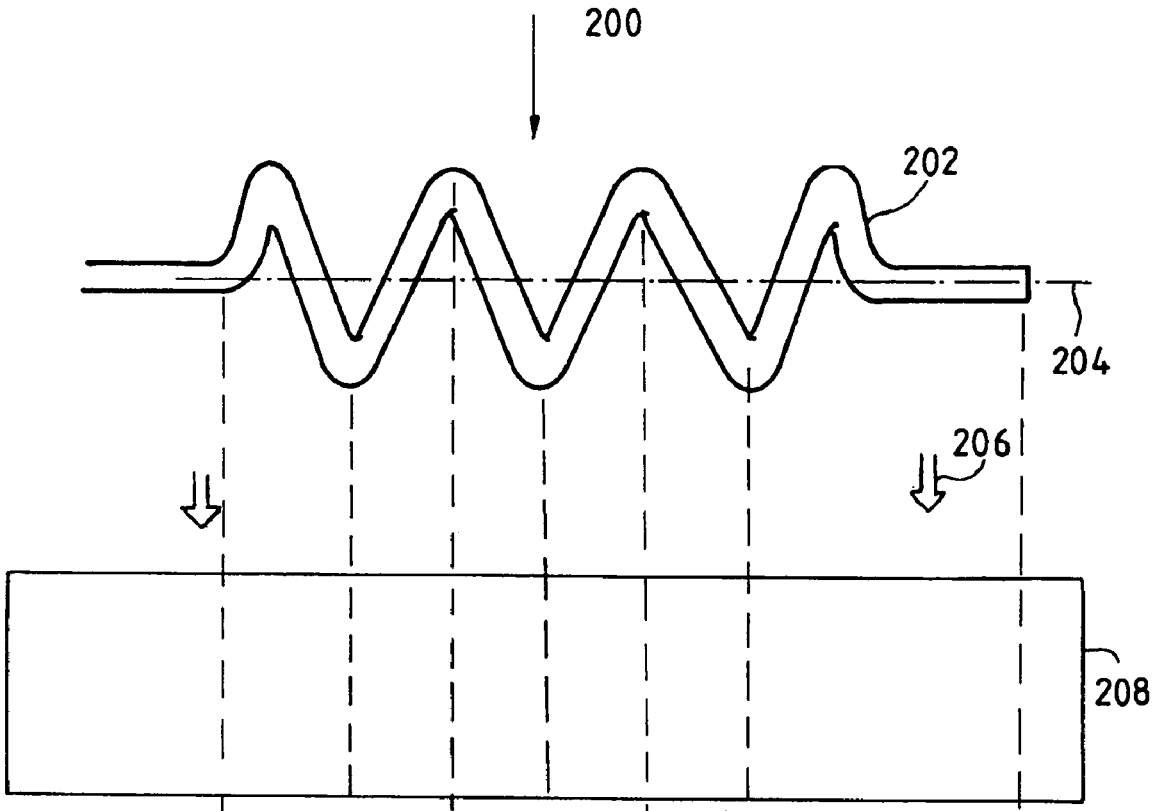
Figure 2B:
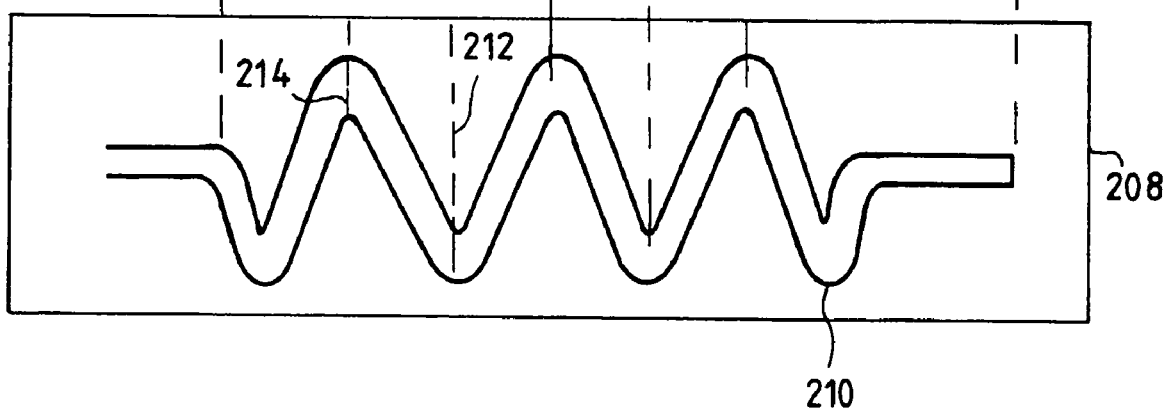

A first method, described with FIGS. 2*a* and 2*b*, is applied when a helical antenna die or model 202 can be realised similar to the antenna to be manufactured showing sufficient rigidity, and particularly a cross-section large enough so that the antenna will not become deformed when it is pushed into a foam element as described hereafter.

Indeed, this helix model 202 is used to produce a print 210 of this model on one face of a volume 208 of foam by laterally pushing, according to a direction 206, the model 202 into this volume until this model 202 is fully inserted into the foam.

Hence, it appears that the cross-section of the model 202 must be large so that this model 202 has sufficient mechanical strength to conform to the volume 208 of foam by marking a print such that, subsequently, conductive material can be printed in the print thus produced as described hereafter.

In fact, on removing the model 202, a three-dimensional print is left in the foam 208, shown diagrammatically in the view according to the arrow 200 by FIG. 2*b*.

When it is not easy to produce a low-cost model having sufficient mechanical characteristics so as not to change shape, or if the conductive wire cross-section is small, it is difficult to print a conductor in the relief of the print thus created.

This is why, according to a second manufacturing method, the print is made in the insulating element 300 by marking onto the surface of this insulating element a print 302, comprising a regular series of parallel grooves 304 along a longitudinal axis 306, called the axis of the helical antenna.

The cross-section of these grooves is determined mathematically beforehand or empirically by calculation methods, for example, by considering that this print corresponds to the lateral projection of an imaginary ideal helical antenna serving as a model for the antenna to be manufactured.

These grooves have a peak to peak pitch 308 equal to the pitch required for the helical antenna to be manufactured. The angle 310 between the longitudinal axis 312 of the grooves and the perpendicular 314 to the antenna axis is the required angle of inclination for the helical antenna to manufacture.

Figure 3A:
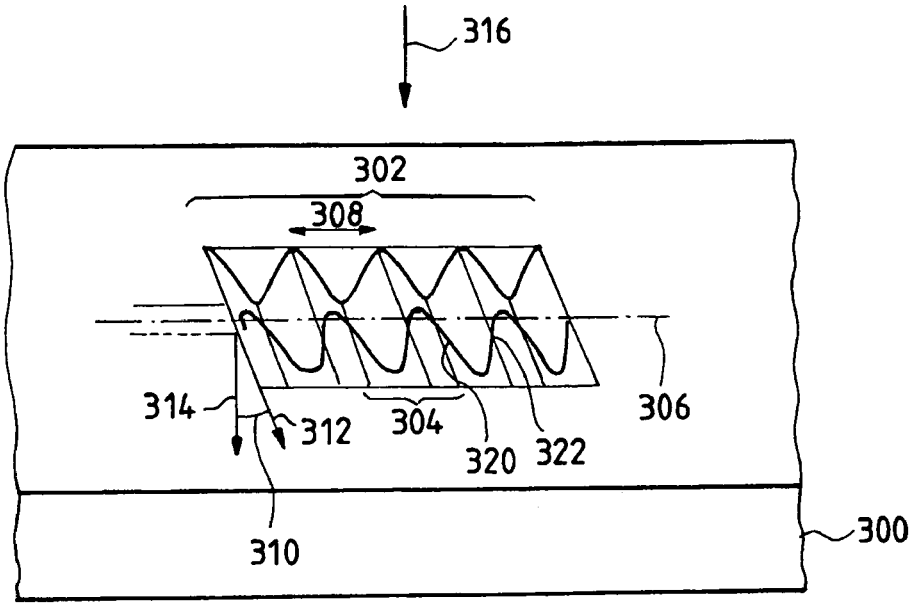
FIGS. 3*a* and 3*b* are diagrams of an insulating element used to manufacture an antenna according to a second embodiment of the invention.
Figure 3B:
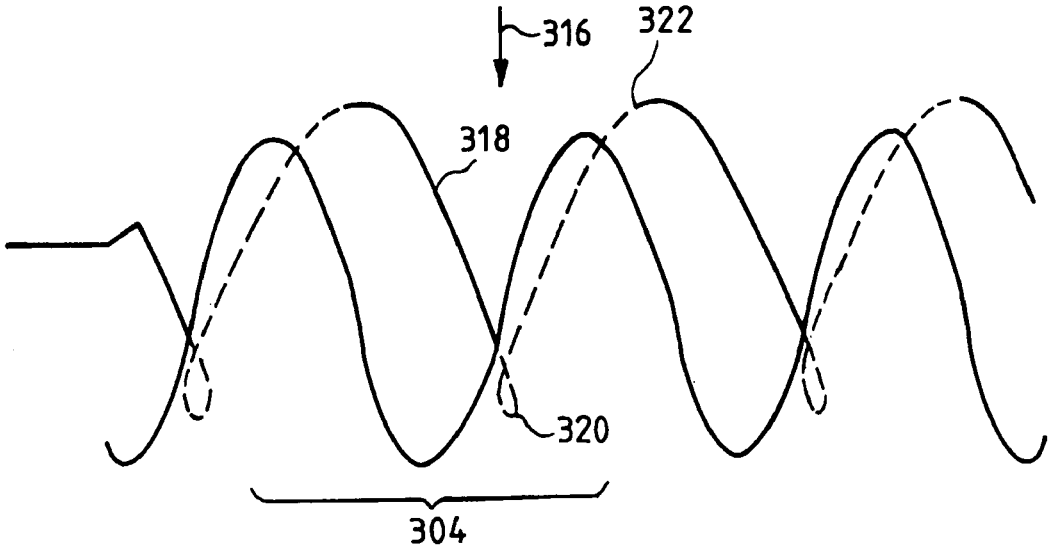

The grooves 304, shown in detail in FIG. 3*b*, have a cross-section such that a curve 318 is obtained describing the same helix, in three dimensions, as the imaginary ideal helix, by projecting the latter helix onto these grooves according to the direction 312, perpendicular to the surface of the insulating element 300.

After the creation of the print according to one or other of the methods described below, a previously manufactured stencil that follows the shape of the print is positioned.

This stencil is, for example, a sheet of moulded metal such as a strip of a width equal to that of the print that is required to be produced, which is cut out in the stencil. This cutting to shape can be achieved for example by a pressure water jet or by a laser perpendicular to the sheet and describing the helix projection on a plane parallel to the helix axis.

When the stencil is in position, a conductive material (e.g. metal) is sprayed according to certain processing parameters, such as time and/or density of spraying, to obtain the required thickness of the conductor on the print and, if necessary, other parts of the insulating element to produce the connection to the helix to be produced. The conductor deposit thus produced on the insulating element describes the required helix in space.

A property of the helix thus formed by depositing conductive material on the insulating element can be noted: the contact surface between the conductive material and the insulating element in the print is located inside the helix for some sections (e.g. at the points 212 of FIG. 2 or 322 of FIG. 3, which corresponds to the peaks of the print) and outside the helix for other sections (e.g. at points 214 of FIG. 2 or 320 of FIG. 3, which corresponds to the grooves of the print).

A network of helixes 400 (FIG. 4) can also be produced by using the method for manufacturing helical antennas to manufacture several antennas on the same insulating element 402, as for example a foam block.

Figure 4:
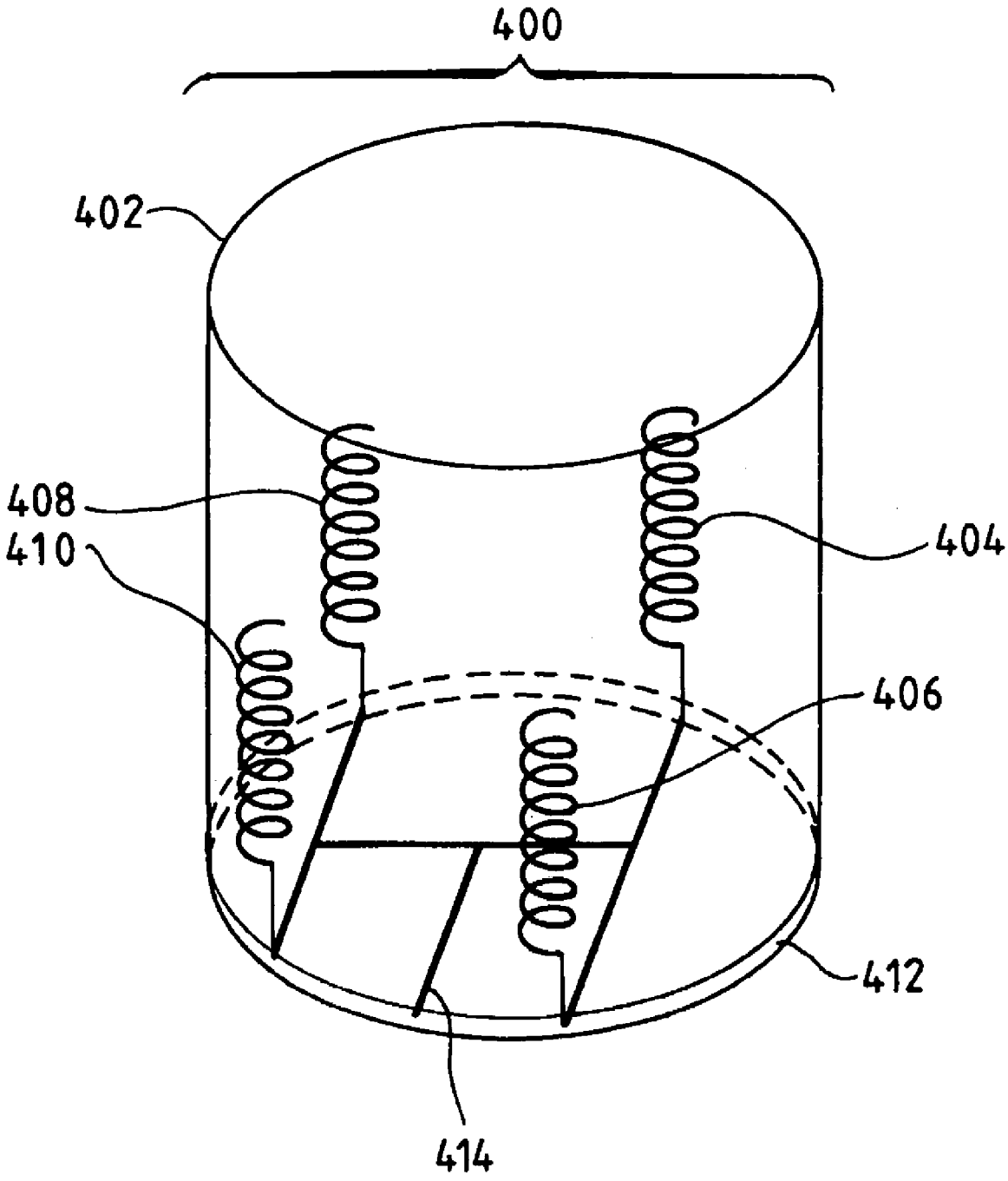
FIG. 4 is a diagram of an embodiment of a network of helical antennas in accordance with the invention.

In the embodiment described below using FIG. 4, four helixes 404, 406, 408 and 410 were produced on the same foam block 402 by using the method of the invention.

Hence, it is possible to combine four helixes on a substrate 412 with a ground plane and an excitation network 414 that can be printed or engraved, for example, such that the entire antenna network is rigid.

This invention can have many variants relating, among others, to the different profiles that can be produced for the radiating elements, to the possible addition of a driver circuit (e.g. a microstrip with substrate and ground plane) and to the materials supporting the antennas according to the dielectric index required.

What is claimed is:

1. Method for manufacturing an antenna in the form of a wire, made of a conductive material, said wire having a helical shape, the method comprising steps of: providing a helical antenna die and an electrical insulation material element, forming a print in relief on one side of the electrically insulating material element by mechanical pressing of the helical die on a surface on the one side of electrical insulation material, and generating the antenna in the form of the wire having the helical shape by depositing the conductive material in the print.

2. The method according to claim 1, further comprising step of forming the electrically insulating material element by moulding.

3. The method according to claim 1, further comprising step of forming the electrically insulating material element by thermo forming.

4. The method according to claim 1, wherein the antenna is formed by depositing a metallic material onto the insulating element.

5. The method according to claim 1, wherein the insulating element is a foam.

6. The method according to claim 1, further comprising step of depositing the conductive material by spraying metallic particles into the print by means of a stencil.

7. The method according to claim 6, wherein the stencil has a relief corresponding to the relief of the surface on the one side of electrical insulation material.

* * * * *